US008876631B2

(12) United States Patent
Cackett et al.

(10) Patent No.: US 8,876,631 B2
(45) **Date of Patent: *Nov. 4, 2014**

(54) GOLF CLUB IRON WITH HIGH DENSITY LEADING EDGE

(71) Applicant: Callaway Golf Company, Carlsbad, CA (US)

(72) Inventors: Matthew T. Cackett, San Diego, CA (US); Brandon T. Vincent, Tega Cay, SC (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/189,620

(22) Filed: Feb. 25, 2014

(65) Prior Publication Data

US 2014/0179461 A1 Jun. 26, 2014

Related U.S. Application Data

(63) Continuation of application No. 13/472,228, filed on May 15, 2012, now Pat. No. 8,668,599.

(60) Provisional application No. 61/490,365, filed on May 26, 2011.

(51) Int. Cl.
*A63B 53/04* (2006.01)

(52) U.S. Cl.
CPC ..... *A63B 53/047* (2013.01); *A63B 53/04* (2013.01)
USPC ..... 473/335; 473/341; 473/348; 473/349; 473/350

(58) Field of Classification Search
USPC ..... 473/335, 336, 338, 348, 349, 350, 341
See application file for complete search history.

(56) References Cited

U.S. PATENT DOCUMENTS

| | | | | |
|---|---|---|---|---|
| 6,902,496 | B2 * | 6/2005 | Solheim et al. | 473/341 |
| 7,153,219 | B2 * | 12/2006 | Reed et al. | 473/290 |
| 8,668,599 | B1 * | 3/2014 | Cackett et al. | 473/335 |
| 2007/0026965 | A1 * | 2/2007 | Huang | 473/342 |

* cited by examiner

*Primary Examiner* — Benjamin Layno
(74) *Attorney, Agent, or Firm* — Rebecca Hanovice; Michael A. Catania; Sonia Lari

(57) ABSTRACT

A golf club iron having a head center of gravity that is low and forward enough to provide a better swing, good striking and swinging feel, and improved ball flight is disclosed. The iron has a recess in a leading edge region and a high density insert disposed within the recess to achieve the desired center of gravity location.

16 Claims, 3 Drawing Sheets

GOLF CLUB IRON WITH HIGH DENSITY LEADING EDGE

CROSS REFERENCES TO RELATED APPLICATIONS

The present application is a continuation of U.S. patent application Ser. No. 13/472,228, filed on May 15, 2012, now U.S. Pat. No. 8,668,599 which claims priority to U.S. Provisional Patent Application No. 61/490,365, filed on May 26, 2011, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a golf club iron having a high density leading edge.

2. Description of the Related Art

Technical innovation in the size, structure, configuration, material, construction, and performance of golf clubs has resulted in a variety of new products. Most irons are constructed in such a way that the head is made from a single type of parent material, such as steel. Some irons have discrete weighting elements incorporated into their structure, but these weights typically are incorporated into sole or perimeter regions located away from the face. As such, most irons currently available on the market do not have a center of gravity (CG) that is located low or forward enough in the head for the head to achieve optimum performance.

BRIEF SUMMARY OF THE INVENTION

One aspect of the present invention is a golf club iron having a head center of gravity that is low and forward enough to provide the iron with a better swing, good striking and swinging feel, and improved ball flight.

Another aspect of the present invention is a golf club comprising a head comprising a face, a sole, a toe, a heel, and a recess, and an insert sized to fit within the recess, wherein the head is composed of a first material having a first density and the insert is composed of a second material having a second density, wherein the second density is greater than the first density, wherein the face has a lower portion adjacent the sole, and wherein the recess is located in at least part of the lower portion of the face and extends into at least part of the sole. The head may be selected from an iron-type golf club head, a wedge-type golf club head, and a hybrid-type golf club head.

In some embodiments, the insert may be secured within the recess via welding, press fit, mechanical entrapment, bonding, or fastening. The second density may be no less than 8 g/cm$^3$ and no more than 20 g/cm$^3$, and the first material may be steel and the second material may be a tungsten alloy. The recess may have a convex bottom portion and the insert may have a concave back portion that mates with the convex bottom portion. Alternatively, the recess may have a flat bottom portion and the insert may have a flat back portion that mates with the flat bottom portion. The recess may extend from a furthest extent of the toe to a furthest extent of the heel, or the recess may extend only part way from the toe to the heel. The face may be integrally formed with the sole. In some embodiments, the head may be cast from stainless steel, and in other embodiments, the head may be forged from a metal alloy.

Another aspect of the present invention is an iron-type golf club head comprising a face, a sole, a heel region, a toe region, and a leading edge region, wherein the face has a lower portion proximate the sole, wherein the leading edge region extends from the lower portion into the sole, wherein the leading edge region comprises a first material having a first density, wherein a remainder of the face and the sole comprises a second material having a second density, and wherein the leading edge region extends from the heel region to the toe region. The first density may be no less than 8 g/cm$^3$ and no more than 20 g/cm$^3$, and the first material may be a tungsten alloy and the second material may be steel, which may be selected from the group consisting of carbon steel and stainless steel.

Yet another aspect of the present invention is an iron-type golf club head comprising a face, a sole, a hosel, and a leading edge region, wherein the face has a lower portion proximate the sole, wherein the leading edge region extends from the lower portion into the sole, wherein the leading edge region comprises a high-density metal alloy, and wherein the face, sole, and hosel are each composed of a steel material. The high-density metal alloy may have a density of no less than 8 g/cm$^3$ and no more than 20 g/cm$^3$, and may be a tungsten alloy. In some embodiments, the steel material may be carbon steel.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The golf club head of the present invention includes a material, located in or around the bottom portion of the face where it meets the sole, having a higher density than that of the material used to form the remainder of the club head. This high density material is attached to the club head via welding, press fit, mechanical entrapment, bonding, fastening, or the like.

Figure 1:
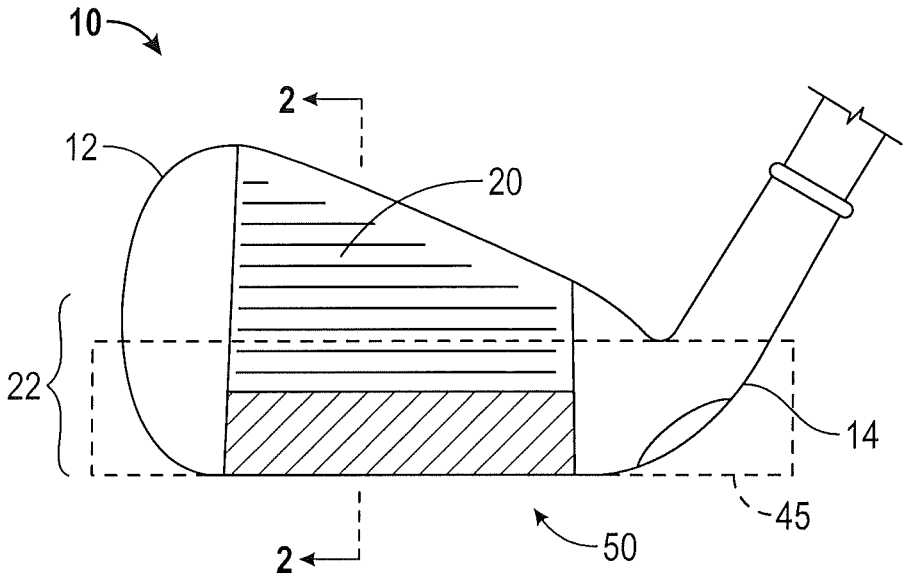
FIG. 1 is a front, plan view of a first embodiment of the present invention.
Figure 2:
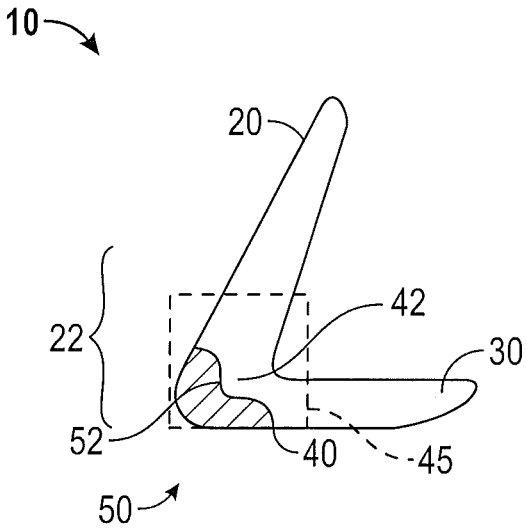
FIG. 2 cross-sectional view along lines 2-2 of the embodiment shown in FIG. 1.

A preferred embodiment of the present invention is shown in FIGS. 1 and 2. The iron-type golf club head 10 of the present invention has a face 20, a sole 30 extending rearwardly from a lower portion 22 of the face 20, and a recess 40 located in region 45 spanning at least part of the lower portion 22 of the face 20 and extending into at least part of the sole 30. This region 45 is commonly known as the leading edge or the "chin" of the golf club iron head. An insert 50 is affixed to the head 10 within the recess 40 via welding, press fit, mechanical entrapment, bonding, fastening, or the like. As shown in FIG.

2, the recess 40 has a convex bottom portion 42 and the insert 50 has a concave back portion 52 that mates with the convex bottom portion 42 and provides additional surface area for welding, bonding, and/or fastening procedures.

Figure 3:
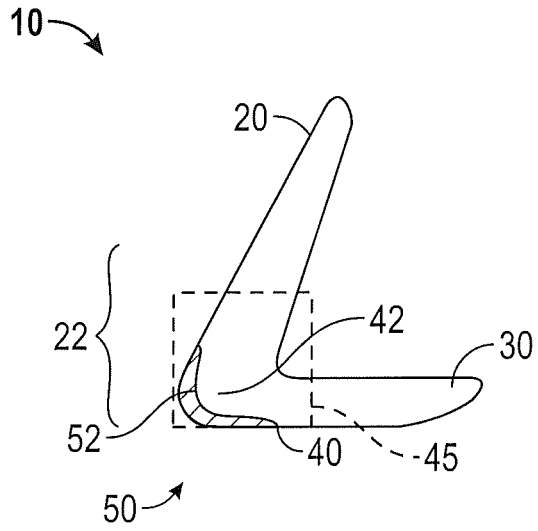
FIG. 3 is a cross-sectional view of a second embodiment of the present invention.
Figure 4:
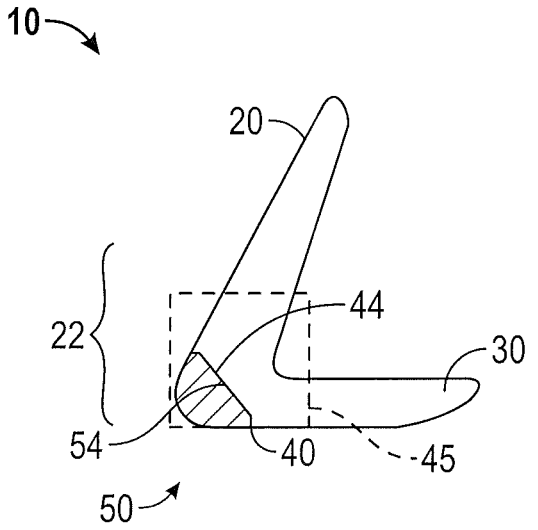
FIG. 4 is a cross-sectional view of a third embodiment of the present invention.

Another embodiment of the present invention is shown in FIG. 3. In this embodiment, the recess 40 has a longer, convex bottom portion 42 and the insert 50 has a longer concave back portion 52 for mating with the convex bottom portion 42. A third embodiment, shown in FIG. 4, has a recess 40 without a convex bottom portion. Instead, the recess 40 has a flat bottom surface 44, and the insert 50 has a flat mating back surface 54 that lines up with and can be affixed to the flat surface 44 of the recess 40.

The insert 50 of the present invention is composed of a material having a density higher than that of the material of the club head 10. The density of the material used to make the insert 50 may range from 7 g/cm$^3$ to 20 g/cm$^3$, and preferably is 18 g/cm$^3$. The head 10 preferably is made of a type of steel material, such as carbon or stainless steel, and the insert 50 preferably is made of a tungsten alloy.

The recess 40 may take up the entire chin or leading edge region 45 of the golf club head 10, extending all the way from the toe 12 of the golf club head to the heel 14, or, as shown in FIG. 1, the recess 40 may extend only part of the way between the toe 12 and the heel 14. The greater the recess 40 size is, the greater the size of the high density insert 50, so a golfer desiring a iron having an extremely heavy chin weight would select a iron head with a recess 40, and thus an insert 50, extending from the furthest reaches of the toe 12 to the furthest reaches of the heel 14 within the chin region 45.

Figure 5:
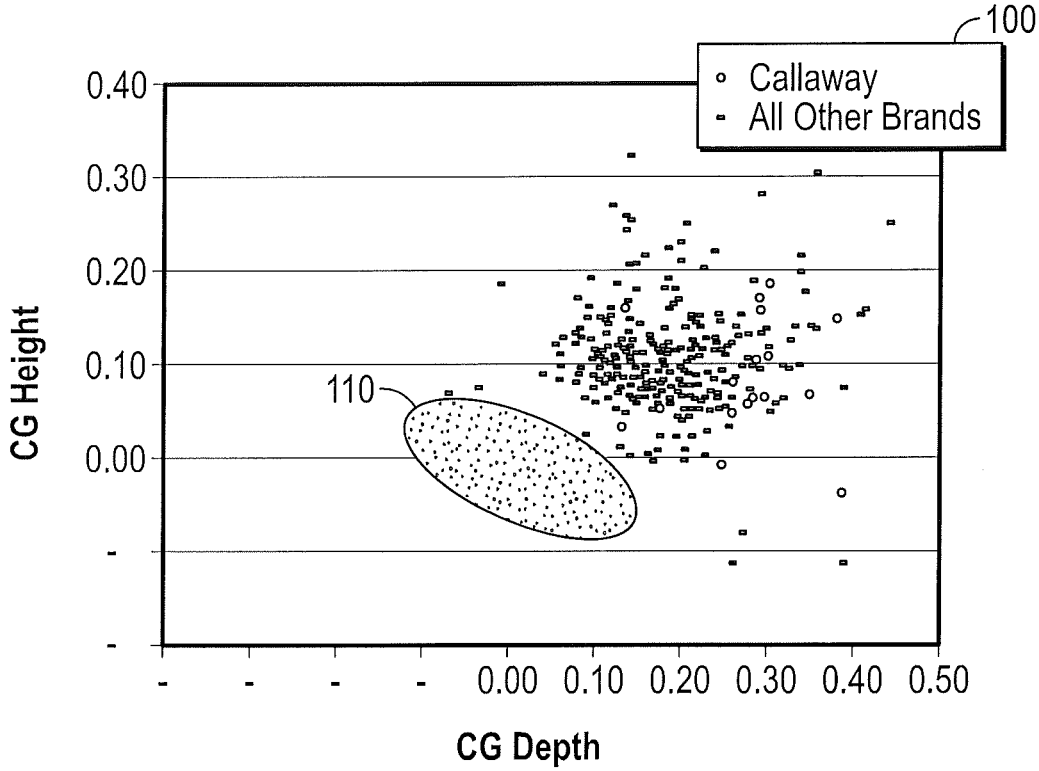
FIG. 5 is a graph showing the center of gravity locations in various iron club heads.

The irons of the present invention have high density leading edges and thus extremely low, forward centers of gravity and moderate loft/de-loft moments of inertia (Iyy). The graph 100 in FIG. 5 shows the center of gravity locations, mapped according to height and depth of the iron head frames, of 6-irons of the present invention and 6-irons currently available on the market. The circled region 110 in the graph indicates the center of gravity locations of irons designed according to the present invention, while the small circles represent Callaway irons and the small dashes represent non-Callaway irons. Center of gravity locations are generally obtainable by referring to the leading edge weights of the irons.

The irons of the present invention may be composed of any number of materials known in the art, including metal alloys and composites. The irons of the present invention may also take any shape or general structure known in the art, including, but not limited to, the shapes and structures disclosed in U.S. Pat. Nos. 5,626,530, 5,749,795, 6,769,998, 7,083,531, 7,338,387, 7,338,389, and 8,043,165, the disclosure of each of which is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:

a head comprising a face, a sole, a toe, a heel, and a recess; and an insert secured within the recess via welding, press fit, mechanical entrapment, bonding, or fastening, wherein the head is composed of a first material having a first density and the insert is composed of a second material having a second density, wherein the face has a lower portion adjacent the sole, wherein the recess is located in at least part of the lower portion of the face and extends into at least part of the sole, and wherein the recess extends from a furthest extent of the toe to a furthest extent of the heel.

2. The golf club of claim 1, wherein the second density is greater than the first density.

3. The golf club of claim 2, wherein the second density is no less than 8 g/cm$^3$ and no more than 20 g/cm$^3$.

4. The golf club of claim 1, wherein the first material is steel and the second material is a tungsten alloy.

5. The golf club of claim 1, wherein the recess has a convex bottom portion and the insert has a concave back portion that mates with the convex bottom portion.

6. The golf club of claim 1, wherein the recess has a flat bottom portion and the insert has a flat back portion that mates with the flat bottom portion.

7. The golf club of claim 1, wherein the insert is welded within the recess.

8. The golf club of claim 1, wherein the head is selected from an iron-type golf club head, a wedge-type golf club head, and a hybrid-type golf club head.

9. The golf club of claim 8, wherein the head is an iron-type golf club head.

10. The golf club of claim 1, wherein the face is integrally formed with the sole.

11. The golf club of claim 10, wherein the head is forged from a metal alloy.

12. The golf club of claim 10, wherein the head is cast from steel.

13. The golf club of claim 12, wherein the steel is selected from the group consisting of carbon steel and stainless steel.

14. The golf club of claim 1, wherein the head comprises a center of gravity height that is less than 0.10 inch.

15. The golf club of claim 14, wherein the head comprises a negative center of gravity height.

16. The golf club of claim 1, wherein the head comprises a center of gravity depth that is less than 0.10 inch.

* * * * *